US012780484B2

(12) United States Patent
Mellecker et al.

(10) Patent No.: US 12,780,484 B2
(45) Date of Patent: Nov. 3, 2026

(54) PACKAGING ARTICLES

(71) Applicants: Kirk Mellecker, Friday Harbor, WA (US); Justin Mellecker, Playa Vista, CA (US)

(72) Inventors: Kirk Mellecker, Friday Harbor, WA (US); Justin Mellecker, Playa Vista, CA (US)

(73) Assignee: Gorilla Packaging Company, LLC, Friday Harbor, WA (US)

( * ) Notice: Subject to any disclaimer, the term of this patent is extended or adjusted under 35 U.S.C. 154(b) by 341 days.

(21) Appl. No.: 18/227,918

(22) Filed: Jul. 29, 2023

(65) Prior Publication Data

US 2025/0033827 A1 Jan. 30, 2025

(51) Int. Cl.

| | |
|---|---|
| ***B65D 5/02*** | (2006.01) |
| ***B65D 5/42*** | (2006.01) |
| ***B65D 5/468*** | (2006.01) |
| ***B65D 5/489*** | (2006.01) |

(52) U.S. Cl.

CPC ..... *B65D 5/0254* (2013.01); *B65D 5/4608* (2013.01); *B65D 5/4802* (2013.01); *B65D 5/4266* (2013.01)

(58) Field of Classification Search

CPC .. B65D 5/5028; B65D 5/5035; B65D 5/5042; B65D 5/5059; B65D 5/5061; B65D 5/5085

USPC ..... 206/521–521.9, 466; 229/115

See application file for complete search history.

(56) References Cited

U.S. PATENT DOCUMENTS 1,758,585 A * 5/1930 Riegel ..... B65D 5/0254 229/115
2,334,997 A * 11/1943 Doll ..... B65D 83/0847 229/175
3,891,136 A * 6/1975 Woeste ..... B65D 85/671 206/815

(Continued)

FOREIGN PATENT DOCUMENTS

FR 2663296 A1 * 12/1991 ..... B65D 5/029
TW M611329 U * 5/2021

OTHER PUBLICATIONS

Annotated Machine Translation (Year: 1991).*
TW M611329 U Machine Translation (Year: 2021).*

*Primary Examiner* — Nathan J Newhouse
(74) *Attorney, Agent, or Firm* — Kirton McConkie; Bryant Keller

(57) ABSTRACT

An improved shipping article includes a single piece of substantially planar material with parallel scores formed therein thereby defining four substantially planar sections of the shipping article, the four planar sections of the shipping article defining, when the piece of substantially planar material is folded along the parallel scores, a first pair of substantially perpendicular adjacent sides having a substantially equal first width, an additional side having a second width that is greater than the first width and formed by two of the four planar sections in an overlapped relationship and one of the planar sections defining the additional side comprising a top extension sized and shaped to fold down to form a top of a compartment enclosed by the first pair of substantially perpendicular adjacent sides and the additional side and a bottom extension sized and shaped to fold up to form a bottom of the compartment.

15 Claims, 7 Drawing Sheets

(56) References Cited

U.S. PATENT DOCUMENTS

| | | | | |
|---|---|---|---|---|
| 5,911,323 | A * | 6/1999 | Bapst | B65D 77/042 229/120.37 |
| 6,123,254 | A * | 9/2000 | Dupuis | B65D 5/2042 229/117.18 |
| 8,523,048 | B1 * | 9/2013 | Spiegelman | B65D 5/48014 229/104 |
| 8,695,848 | B2 * | 4/2014 | Cook | B65D 83/0805 206/436 |
| 2014/0158578 | A1 * | 6/2014 | Varan | B65D 5/0281 206/521 |
| 2019/0031390 | A1 * | 1/2019 | Hessburg | B65D 5/02 |
| 2022/0177182 | A1 * | 6/2022 | Mellecker | B65D 71/36 |

* cited by examiner

PACKAGING ARTICLES

BACKGROUND OF THE INVENTION

1. Field of the Invention

The present invention relates to packaging articles, and more particularly to improved packaging articles for shipping fragile items.

2. Background and Related Art

Articles for shipping fragile items such as glass bottles, cans, and other beverage containers need to provide adequate protection for the shipped items. Thus, the shipping articles should be able to dampen vibration and absorb shock from any angle. Ideally, such shipping articles should also be durable, lightweight, affordable, environmentally friendly, and easy-to-use. Once shipped items arrive at their destination, it should also be easy for the recipient to remove the shipped articles without damaging them.

BRIEF SUMMARY OF THE INVENTION

Implementation of the invention provides improved shipping articles that satisfy the needs for shipping of fragile items such as glass bottles, cans, and other beverage containers. Such shipping articles are filled and inserted into a secondary shipping container, such as an external box, for shipping of the items with adequate protection for the fragile items. The fragile items are protected from vibration and shock during shipping.

Certain implementations of the invention provide an improved shipping article including a single piece of substantially planar material with parallel scores formed therein thereby defining four substantially planar sections of the shipping article, the four planar sections of the shipping article defining, when the piece of substantially planar material is folded along the parallel scores, a first pair of substantially perpendicular adjacent sides having a substantially equal first width, an additional side having a second width that is greater than the first width and formed by two of the four planar sections in an overlapped relationship, and one of the planar sections defining the additional side including a top extension sized and shaped to fold down to form a top of a compartment enclosed by the first pair of substantially perpendicular adjacent sides and the additional side, and a bottom extension sized and shaped to fold up to form a bottom of the compartment.

In some implementations, the top extension includes a hole therein sized to receive a human finger or thumb to facilitate lifting of the shipping article by the top extension during insertion of or removal of the shipping article into or from a secondary shipping container. In some implementations, the top extension includes two holes spaced apart therein, each sized to receive a human finger or thumb to facilitate lifting of the shipping article by the top extension during insertion of or removal of the shipping article from a secondary shipping container. In some implementations, the compartment has a substantially triangular cross-section when taken substantially perpendicular to the material of the sides.

In some implementations, the substantially planar material further includes a plurality of slits extending between adjacent sides of the first pair of sides separating portions thereof above and below, respectively, the top and the bottom of the compartment, thereby permitting the portions above and below the top and the bottom of the compartment to be inwardly displaced after the piece of substantially planar material is folded and the top and the bottom of the compartment are folded down and up, respectively, to hold the top and the bottom of the compartment in place. In some implementations, the piece of substantially planar material includes one of the plurality of slits for the top and another of the plurality of slits for the bottom of the compartment.

In some implementations, one or more of the sides of the first pair of substantially perpendicular sides includes an item-separating shelf formed as a portion of the single piece of substantially planar material detached from its respective side except along a line substantially perpendicular to the parallel scores, whereby the shelf is adapted to fold into the compartment to separate such compartment into vertically spaced sub-compartments. In some implementations, the shipping article includes item-separating shelves such as one item-separating shelf separating the compartment into two sub-compartments, two item-separating shelves separating the compartment into three sub-compartments, or three item-separating shelves separating the compartment into four sub-compartments.

In some implementations, the single piece of material includes corrugated cardboard. In some implementations, the compartment is sized to receive items such as wine bottles, aluminum beverage cans, beverage bottles, beverage growlers, beverage crowlers, or beverage bombers. In some implementations, when the shipping article is folded, the shipping article contains and protects an item in the compartment between the top and bottom formed by the top and bottom extensions sized and shaped to fold down and up, respectively, from one of the planar sections defining the additional side, and wherein the shipping article is located within an external box that encloses the shipping article, a first crush void above the top, and a second crush void below the bottom, the first and second crush voids being defined by portions of the first pair of substantially perpendicular adjacent sides that extend beyond the bottom and the top.

In some implementations, the shipping article is folded and contained with one or more additional shipping articles inside an external box.

According to certain implementations, an improved shipping article includes a single piece of substantially planar material with parallel scores formed therein thereby defining four substantially planar sections of the shipping article, the four planar sections of the shipping article defining, when the piece of substantially planar material is folded along the parallel scores, a first pair of substantially perpendicular adjacent sides having a substantially equal first width, an additional side having a second width that is greater than the first width and formed by two of the four planar sections in an overlapped relationship, one of the planar sections including a top extension sized and shaped to fold down to form a top of a compartment enclosed by the first pair of substantially perpendicular adjacent sides and the additional side, and a bottom extension sized and shaped to fold up to form a bottom of the compartment.

In some implementations, the top extension includes two holes spaced apart therein, each sized to receive a human finger or thumb to facilitate lifting of the shipping article by the top extension during insertion of or removal of the shipping article from a secondary shipping container. In some implementations, the compartment has a substantially triangular cross-section when taken substantially perpendicular to the material of the three sides.

In some implementations, the substantially planar material further includes a plurality of slits extending between adjacent sides of the first pair of sides separating portions thereof above and below, respectively, the top and the bottom of the compartment, thereby permitting the portions above and below the top and the bottom of the compartment to be inwardly displaced after the piece of substantially planar material is folded and the top and the bottom of the compartment are folded down and up, respectively, to hold the top and the bottom of the compartment in place.

In some implementations, one or more of the sides of the first pair of substantially perpendicular sides includes an item-separating shelf formed as a portion of the single piece of substantially planar material detached from its respective side except along a line substantially perpendicular to the parallel scores, whereby the shelf is adapted to fold into the compartment to separate such compartment into vertically spaced sub-compartments. In some implementations, the shipping article includes item-separating shelves such as one item-separating shelf separating the compartment into two sub-compartments, two item-separating shelves separating the compartment into three sub-compartments, or three item-separating shelves separating the compartment into four sub-compartments.

In some implementations, the single piece of material includes corrugated cardboard. In some implementations, when the shipping article is folded, the shipping article contains and protects an item in the compartment between the top and bottom formed by the top and bottom extensions sized and shaped to fold down and up, respectively, from one of the planar sections defining the additional side, and wherein the shipping article is located within an external box that encloses the shipping article, a first crush void above the top, and a second crush void below the bottom, the first and second crush voids being defined by portions of the first pair of substantially perpendicular adjacent sides that extend beyond the bottom and the top.

BRIEF DESCRIPTION OF THE SEVERAL VIEWS OF THE DRAWINGS

The objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which:

DETAILED DESCRIPTION OF THE INVENTION

Figure 1:
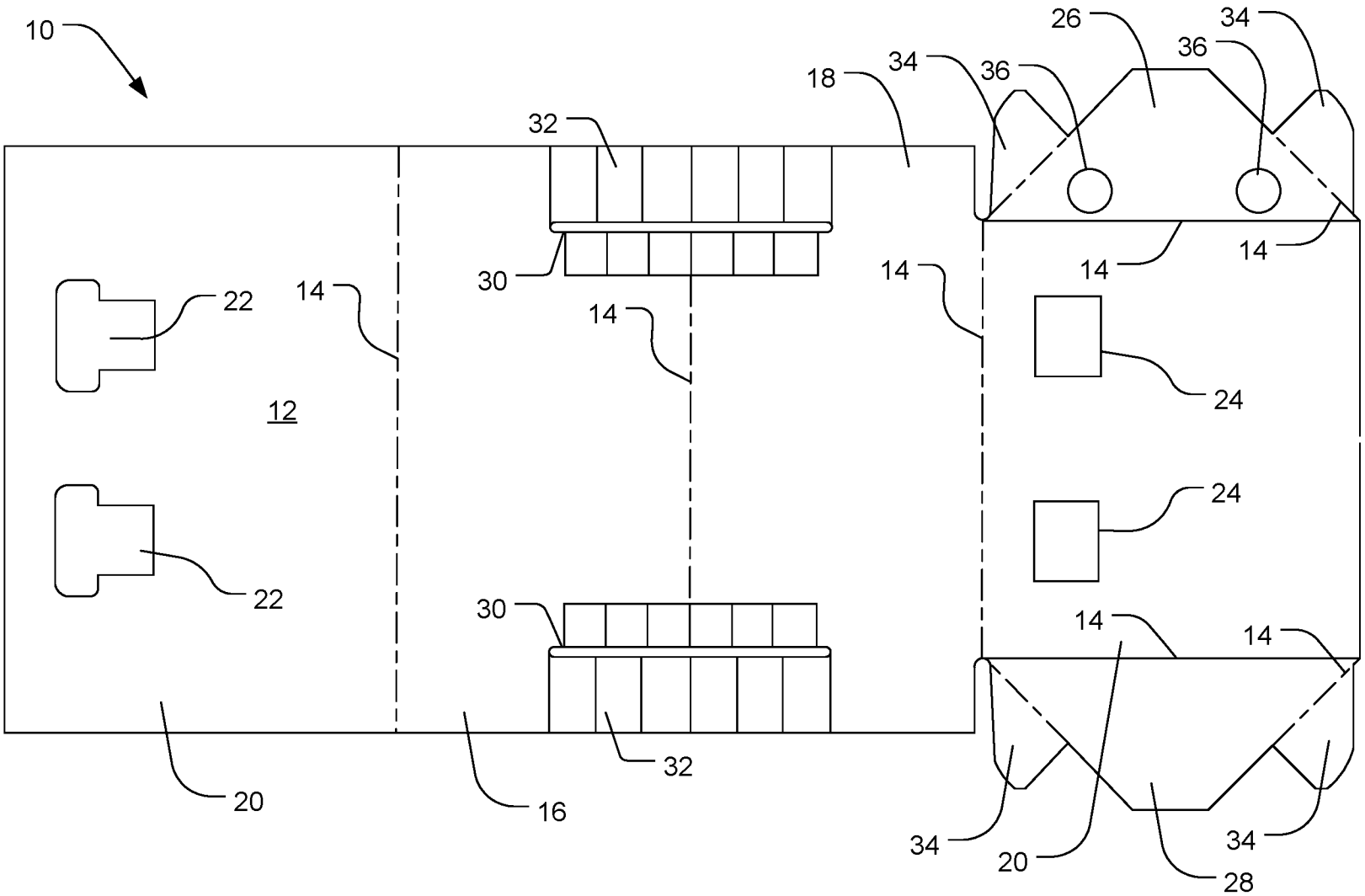
FIG. 1 shows a plan (flat, unfolded) view of an exemplary shipping article.

A description of embodiments of the present invention will now be given with reference to the Figures. It is expected that the present invention may take many other forms and shapes, hence the following disclosure is intended to be illustrative and not limiting, and the scope of the invention should be determined by reference to the appended claims.

Certain embodiments of the invention provide an improved shipping article including a single piece of substantially planar material with parallel scores formed therein thereby defining four substantially planar sections of the shipping article, the four planar sections of the shipping article defining, when the piece of substantially planar material is folded along the parallel scores, a first pair of substantially perpendicular adjacent sides having a substantially equal first width, an additional side having a second width that is greater than the first width and formed by two of the four planar sections in an overlapped relationship, and one of the planar sections defining the additional side including a top extension sized and shaped to fold down to form a top of a compartment enclosed by the first pair of substantially perpendicular adjacent sides and the additional side, and a bottom extension sized and shaped to fold up to form a bottom of the compartment.

In some embodiments, the top extension includes a hole therein sized to receive a human finger or thumb to facilitate lifting of the shipping article by the top extension during insertion of or removal of the shipping article into or from a secondary shipping container. In some embodiments, the top extension includes two holes spaced apart therein, each sized to receive a human finger or thumb to facilitate lifting of the shipping article by the top extension during insertion of or removal of the shipping article from a secondary shipping container. In some embodiments, the compartment has a substantially triangular cross-section when taken substantially perpendicular to the material of the sides.

In some embodiments, the substantially planar material further includes a plurality of slits extending between adjacent sides of the first pair of sides separating portions thereof above and below, respectively, the top and the bottom of the compartment, thereby permitting the portions above and below the top and the bottom of the compartment to be inwardly displaced after the piece of substantially planar material is folded and the top and the bottom of the compartment are folded down and up, respectively, to hold the top and the bottom of the compartment in place. In some embodiments, the piece of substantially planar material includes one of the plurality of slits for the top and another of the plurality of slits for the bottom of the compartment.

In some embodiments, one or more of the sides of the first pair of substantially perpendicular sides includes an item-separating shelf formed as a portion of the single piece of substantially planar material detached from its respective side except along a line substantially perpendicular to the parallel scores, whereby the shelf is adapted to fold into the compartment to separate such compartment into vertically spaced sub-compartments. In some embodiments, the shipping article includes item-separating shelves such as one item-separating shelf separating the compartment into two sub-compartments, two item-separating shelves separating the compartment into three sub-compartments, or three item-separating shelves separating the compartment into four sub-compartments.

In some embodiments, the single piece of material includes corrugated cardboard. In some embodiments, the compartment is sized to receive items such as wine bottles, aluminum beverage cans, beverage bottles, beverage growlers, beverage crowlers, or beverage bombers. In some embodiments, when the shipping article is folded, the shipping article contains and protects an item in the compartment between the top and bottom formed by the top and bottom extensions sized and shaped to fold down and up, respectively, from one of the planar sections defining the additional side, and wherein the shipping article is located within an external box that encloses the shipping article, a first crush void above the top, and a second crush void below the bottom, the first and second crush voids being defined by portions of the first pair of substantially perpendicular adjacent sides that extend beyond the bottom and the top.

In some embodiments, the shipping article is folded and contained with one or more additional shipping articles inside an external box.

According to certain embodiments, an improved shipping article includes a single piece of substantially planar material with parallel scores formed therein thereby defining four substantially planar sections of the shipping article, the four planar sections of the shipping article defining, when the piece of substantially planar material is folded along the parallel scores, a first pair of substantially perpendicular adjacent sides having a substantially equal first width, an additional side having a second width that is greater than the first width and formed by two of the four planar sections in an overlapped relationship, one of the planar sections including a top extension sized and shaped to fold down to form a top of a compartment enclosed by the first pair of substantially perpendicular adjacent sides and the additional side, and a bottom extension sized and shaped to fold up to form a bottom of the compartment.

In some embodiments, the top extension includes two holes spaced apart therein, each sized to receive a human finger or thumb to facilitate lifting of the shipping article by the top extension during insertion of or removal of the shipping article from a secondary shipping container. In some embodiments, the compartment has a substantially triangular cross-section when taken substantially perpendicular to the material of the three sides.

In some embodiments, the substantially planar material further includes a plurality of slits extending between adjacent sides of the first pair of sides separating portions thereof above and below, respectively, the top and the bottom of the compartment, thereby permitting the portions above and below the top and the bottom of the compartment to be inwardly displaced after the piece of substantially planar material is folded and the top and the bottom of the compartment are folded down and up, respectively, to hold the top and the bottom of the compartment in place.

In some embodiments, one or more of the sides of the first pair of substantially perpendicular sides includes an item-separating shelf formed as a portion of the single piece of substantially planar material detached from its respective side except along a line substantially perpendicular to the parallel scores, whereby the shelf is adapted to fold into the compartment to separate such compartment into vertically spaced sub-compartments. In some embodiments, the shipping article includes item-separating shelves such as one item-separating shelf separating the compartment into two sub-compartments, two item-separating shelves separating the compartment into three sub-compartments, or three item-separating shelves separating the compartment into four sub-compartments.

In some embodiments, the single piece of material includes corrugated cardboard. In some embodiments, when the shipping article is folded, the shipping article contains and protects an item in the compartment between the top and bottom formed by the top and bottom extensions sized and shaped to fold down and up, respectively, from one of the planar sections defining the additional side, and wherein the shipping article is located within an external box that encloses the shipping article, a first crush void above the top, and a second crush void below the bottom, the first and second crush voids being defined by portions of the first pair of substantially perpendicular adjacent sides that extend beyond the bottom and the top.

The Figures illustrate various embodiments of improved shipping articles 10. FIG. 1 illustrates a plan/flat view of a first embodiment of the shipping article 10 in its flat, unfolded state. The shipping article 10 is formed of a single piece of substantially planar material 12. After initial forming of the shipping article 10 (e.g., by cutting, scoring, folding, and the like), the shipping article 10 may not be naturally strictly planar. In other words, the formed shipping article may be prone to bending at any score lines, for example. Additionally, the material 12, prior to forming of the shipping article 10, may have some not strictly planar portions (e.g., due to natural undulations or the like), but the material 12 should still be viewed as being "substantially planar."

In certain embodiments, the substantially planar material 12 is a paperboard or a plastic board product. In some exemplary embodiments, the substantially planar material 12 is a corrugated paperboard product such as 40 edge crush test (40 ECT) or some other strength corrugated board. The strength of the substantially planar material 12, in some embodiments, is selected to allow the shipping article 10 to support the weight load of the anticipated contents of the shipping article 10. The shipping article 10 may be formed of any desired substantially planar material 12 as long as the shipping article 10 so formed satisfies desired strength, durability, weight, cost, and/or other characteristics, and one of ordinary skill in the art will be able to determine appropriate materials or alternate materials for the substantially planar material 12.

In some embodiments, the material 12 is pre-readied for being formed into the shipping article 10 by a process of cutting, perforating, scoring and/or pre-folding the material 12. In other embodiments, the shipping article 10 formation process also includes a step of forming the substantially planar material 12, which may include a first step of cutting or forming the substantially planar material 12 in the overall shape of the finished shipping article 10, which is then further formed by cutting, perforating, scoring, creasing, and/or folding the material. In certain embodiments, the material 12 is formed into the shipping article 10 at a manufactory while retaining its substantially planar configuration. The shipping article 10 is then transported (e.g., shipped) to an end user (e.g., as a stack of substantially planar shipping articles 10). The end user then folds the material 12 along pre-formed score lines 14 or creases to form the folded shipping article 10 ready to receive contents for shipping.

The score lines 14 formed in the material 12 define substantially planar sections of the shipping article 10 that are formed when the material 12 is folded by the end user. A series of substantially parallel score lines 14 divide the material 12 into sides and dividing walls of the shipping article 10 in the embodiment of FIG. 1. In particular, the parallel score lines 14 divide the material 12 into a first side 16, a second side 18, and a pair of additional planar sections 20. When the shipping article 10 is folded into its folded configuration, the first side 16 and the second side 18 are arranged to be substantially perpendicular to each other and are adjoining to define two short sides of an enclosed right triangular prismatic volume.

Figure 2:
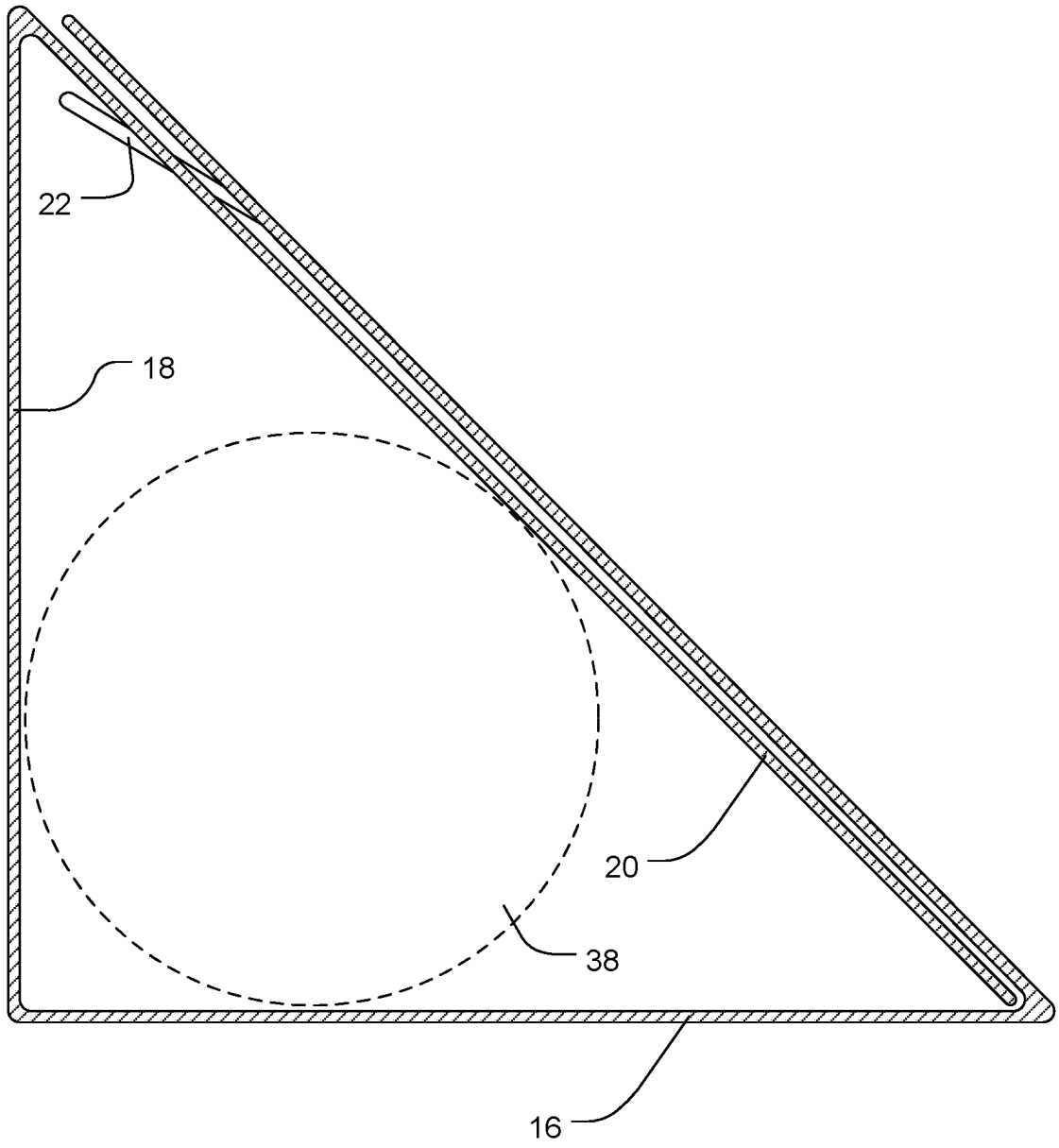
FIG. 2 shows a top-down cross-sectional view of the shipping article of FIG. 1 in a partially folded state.

When the shipping article 10 is in its folded configuration, the two additional planar sections 20 are located immediately adjacent to each other forming a long side of the enclosed volume. The additional planar sections 20 extend between opposite legs of the shipping article 10 such that the additional planar sections 20 complete the enclosed volume having a general shape of a triangular prism. FIG. 2 illustrates an illustrative cross-sectional view of the shipping article 10 of FIG. 1 in its partially folded configuration after the material 12 has been folded along the parallel score lines 14 to encompass the generally triangular-prism-shaped volume making up the enclosed volume. The view of FIG. 2 is not necessarily to scale to facilitate illustrating the functionality of the folding of the material 12 to form the shipping article 10. By way of the folding of the material 12 in the manner shown in FIG. 2, the first side 16 and the second side 18 form a compartment for protecting the contents of the shipping article 10.

When the material 12 is initially formed, one or more locking tabs 22 (two are illustrated in the embodiment of FIG. 1) are cut into the material 12 such that the locking tabs 22 are formed from the material of one of the additional planar sections 20 such that the locking tabs 22 thereby effectively form an extension of the material of one of the additional planar sections 20 (as in the embodiment of FIG. 1). Corresponding locking slots 24 or locking holes are also cut into the other of the additional planar sections 20. The one or more corresponding locking slots 24 are located in the additional planar sections 20 and positioned such that when the material 12 is folded into the partially folded configuration of FIG. 2, the locking tabs 22 will be located immediately adjacent the locking slots 24 and can be pushed into the locking slots 24. Pushing the locking tabs 22 into the locking slots 24 secures the material 12 in the partially-folded state, as is also seen in FIG. 2.

The shipping article 10, as originally formed in its substantially planar state, also includes score lines 14 on one of the additional planar sections 20 that are substantially perpendicular to the series of parallel score lines 14 discussed previously. These perpendicular score lines 14 delineate end portions of the additional planar section 20 that form a top extension 26 and a bottom extension 28 of that additional planar section 20. The top extension 26 and the bottom extension 28 serve to be folded to form a top and a bottom, respectively, of the compartment, as shown in top-down perspective view of FIG. 4 (only the top extension 26 is shown in this view). Corresponding extension-securing slits 30 are formed extending between the adjacent first side 16 and second side 18, such that the slits 30 are disposed opposite the additional planar sections 20 when the shipping article 10 is in its folded state. The slits 30 serve to separate a portion of the adjacent first side 16 and second side 18 above the upper slit 30 and below the lower slit 30 such that the separated portion can be displaced inwardly toward the additional planar sections 20 after the top extension 26 is folded down and the bottom extension 28 is folded up, thereby forming retaining members 32. The retaining members 32 hold the top extension 26 and the bottom extension 28 in their folded positions whereby they form a secure top and bottom to the compartment.

Figure 3:
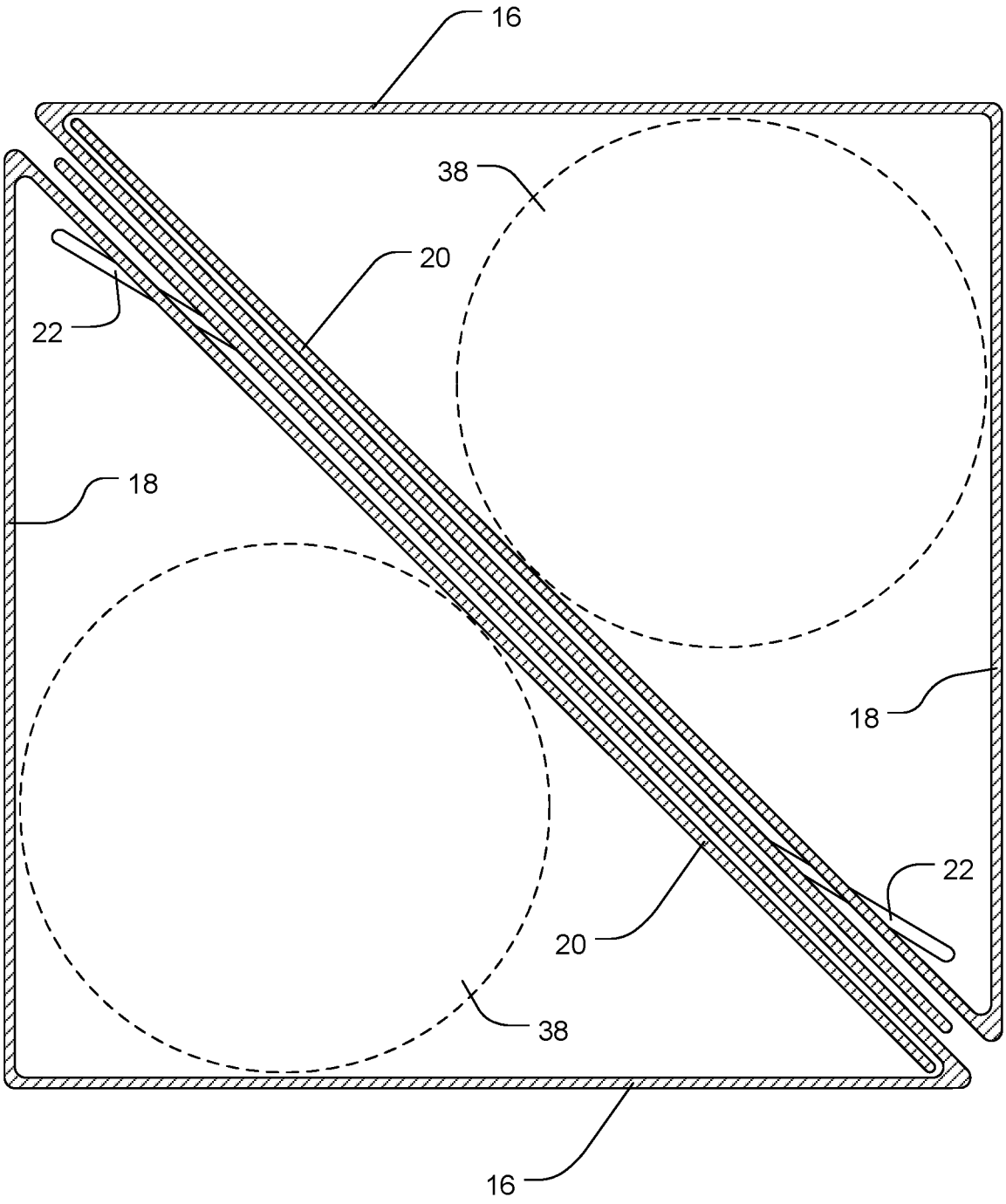
FIG. 3 shows a top-down cross-sectional view of the shipping article of FIG. 1 with an additional shipping article of FIG. 1 (both in partially-folded states) disposed in a complementary relationship for disposition within an external shipping container.

In some embodiments, as illustrated in FIGS. 1 and 3, the top extension 26 and the bottom extension 28 each includes tabs 34 joined to the respective extension 26, 28 at further score lines 14. The tabs 34 fold up (or down) adjacent to the first side 16 and the second side 18, as shown in FIG. 3, when the top extension 26 and the bottom extension 28 are folded inward, thereby providing additional strength to the top extension 26 and the bottom extension 28.

Figure 4:
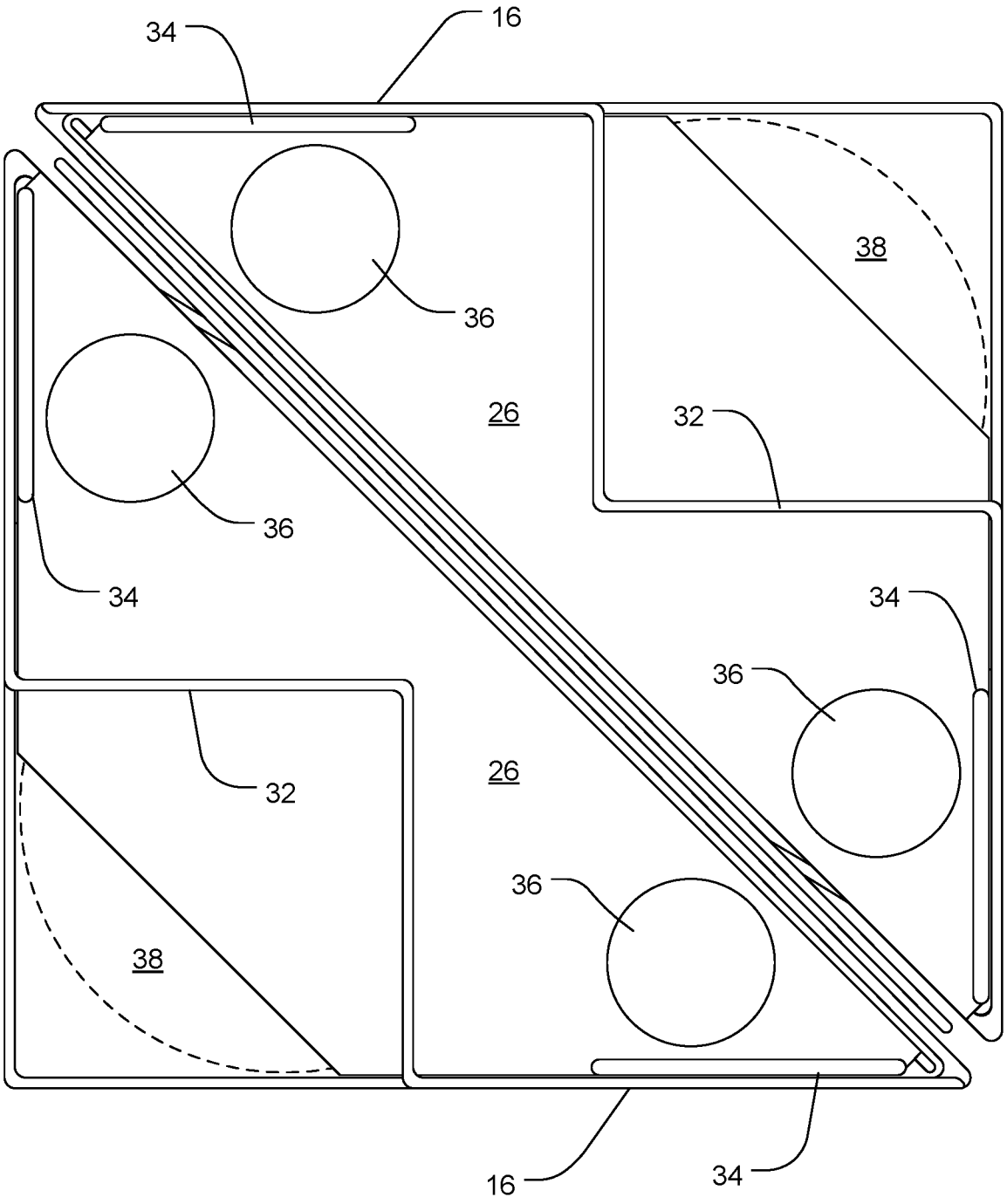
FIG. 4 shows a top-down perspective view of the two shipping articles of FIG. 3 in a fully folded state.

In certain embodiments, as also illustrated in FIGS. 1 and 4, the top extensions 26 each include a hole 36 (or holes 36) sized to receive a finger or thumb therethrough. When the shipping article 10 is in its fully folded shape as shown in FIG. 4, the hole or holes 36 are adapted and positioned to permit a user to insert a thumb and/or finger into the hole or holes 36, whereby the user can lift the shipping article 10 (with any items contained in the compartment) into or out of a secondary shipping container. In some embodiments, the secondary shipping container is a separate shipping article sized to receive a single shipping article 10 therein with its contents. In other embodiments, the secondary shipping container is a separate shipping article sized to receive two shipping articles 10 therein with their contents, in the manner illustrated in FIGS. 3 and 4. In other embodiments, the secondary shipping container is sized to receive multiple of the shipping articles 10 therein with their contents. Regardless, the placement of the holes 36 greatly facilitates such placement and removal.

The secondary shipping container serves to provide further protection to the contents of the shipping article 10. In particular, two layers of protection are formed around all outer sides of the compartment, and there are additional layers of protection around the compartment provided by the additional planar sections 20. Furthermore, the top extension 26 and the bottom extension 28 forming the top and bottom of the compartment, respectively, provide a space above and below the compartment within the secondary shipping container. Accordingly, the contents of the compartment are further protected against impacts to the contents, especially at the corners thereof, where damage is most likely to occur.

The shipping article 10 as illustrated in FIGS. 1-4 is especially adapted to protect fragile items, such as wine and alcohol bottles and other beverage containers such as beer cans and the like during shipping. As particularly illustrated in FIG. 2, the individual contents 38 of the shipping article 10 may have a generally circular maximum cross-sectional dimension that fits generally snugly within the compartment and is protected by the shipping article 10. Each individual shipping article of FIGS. 1-4 is generally adapted to secure one item during shipping, although it may be used to secure more than one item if such items are not prone to breakage, or shipping of additional items may be achieved by including multiple folded shipping articles 10 within a single secondary shipping container.

Figure 5:
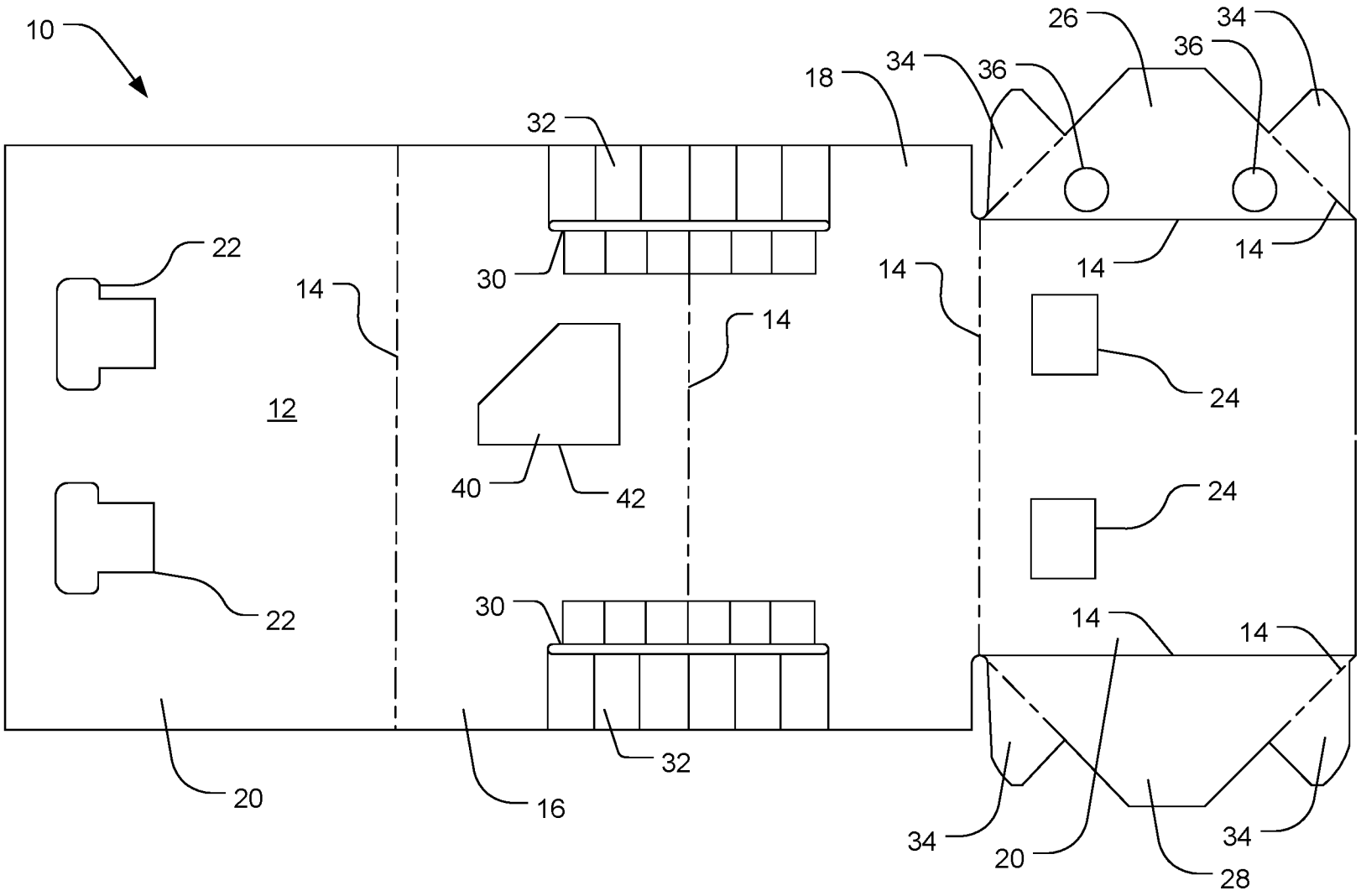
FIG. 5 shows a plan (flat, unfolded) view of an alternate exemplary shipping article.

Alternate embodiments of the shipping article 10 are adapted to receive more than one item for shipping while still providing separation and protection to all items contained in the shipping article. In particular, FIG. 5 illustrates a plan/flat view of one alternate embodiment of the shipping article 10. This embodiment is adapted to contain two items during shipping while protecting such items both from externally caused damage and damage between items. In the embodiment illustrated in FIG. 4, the shipping article 10 is adapted to form the compartment as discussed with respect to the embodiment of FIGS. 1-4, but is further adapted to divide the compartment vertically into two sub-compartment.

The compartment's separation into sub-compartments is achieved by way of an item-separating shelf 40 that is formed from the unitary sheet of material 12 and is cut along all but one edge 42 thereof so to be separated from the respective first side 16 or second side 18 where they are located. A score or crease is optionally formed at the remaining edge 42 to facilitate folding of the shelf 40 into the compartment. When the shelf 40 is folded into the compartment, the shelf 40 extends in a plane generally perpendicular to the planes of the first side 16 and second side 18, and occupies a major portion of the compartment, thereby serving to protect objects in one sub-compartment against impacts from objects in the other, adjacent, sub-compartment. As may be appreciated, appropriate sizing of the sub-compartments can be used to minimize shifting or movement of the contents of the shipping article 10 therein such that the protection afforded by the shelf 40 is adequate to protect the contents.

As may be appreciated by comparing the embodiment of FIGS. 1-4 with the embodiment of FIG. 5, the shipping article 10, when folded, forms sub-compartments that are approximately half the total height of the compartment of a similarly sized shipping article 10. Accordingly, though not specifically illustrated in the Figures, the shipping article 10 may be formed taller to accommodate a stack of two items in each sub-compartment when similar items are contained in a compartment of a one-item shipping article 10 as opposed to a two-item (with shelf 40) shipping article 10. One of ordinary skill in the art can readily appreciate the variations in sizes that may be used to accommodate a variety of items of varying sizes and of varying numbers.

While the embodiment of FIGS. 1-4 is adapted to contain one (e.g., one wine bottle) and the embodiment of FIG. 5 is adapted to contain two items (e.g., two beer bottles or beer cans or wine bottles, but potentially two cans or bottles of other beverage, etc., as sized and adapted), other embodiments are possible. Indeed, other embodiments may be formed and adapted to contain three items (e.g., three cans of beer or other beverage). Other than variations in sizing (e.g., height) of the shipping article 10, such embodiment is similar in features to the embodiment of FIG. 5, but includes two vertically-spaced shelves 40. The primary functional difference (other than sizing) is in the number and placement of the item-separating shelves 40. In the embodiment of FIG. 5, the edge 42 is vertically centrally placed on its first side 16 (though it could alternatively be placed on the second side 18), thereby vertically dividing the shipping article equally into two sub-compartments between the slits 30. In other embodiments, the edges 42 of two shelves 40 are spaced vertically on their first side 16 and/or second side 18 at thirds between the slits 30. This placement thus divides the compartment equally in thirds between the slits 30 into three sub-compartments. As may be appreciated, the respective cross-sectional view of each such embodiment may be essentially similar.

While FIGS. 1-5 illustrate embodiments of the shipping article 10 having certain numbers and relative sizes of compartment and/or sub-compartments, it should be understood that embodiments of the shipping article 10 are not limited to the embodiments illustrated in the Figures. Some embodiments of the shipping article 10 have differing numbers or sizes of sub-compartments. Other embodiments of the shipping article 10 have sub-compartments with different proportions than those discussed, such as one taller and one shorter sub-compartment.

The embodiments of the shipping article 10 illustrated in FIG. 5 include embodiments of the finger hole 36. As with the embodiment of the shipping article 10 illustrated in FIGS. 1-4, the finger holes 36 may be used by an end user to facilitate placement of the shipping article 10 into a secondary shipping container or by a purchaser to facilitate removal of the shipping article 10 from the secondary shipping container. Alternate embodiments of the shipping article 10 are sized similarly to the embodiments of the shipping article 10 shown in FIGS. 1-5, and include or lack the shelves, but lack the finger holes 36. In such embodiments, placement of the shipping article 10 into or removal of the shipping article 10 from the secondary container is achieved by other means (such as by grasping the retaining members 32, by holding the exterior of the shipping article 10, or, in the case of removal, by tilting the secondary shipping container).

Figure 6:
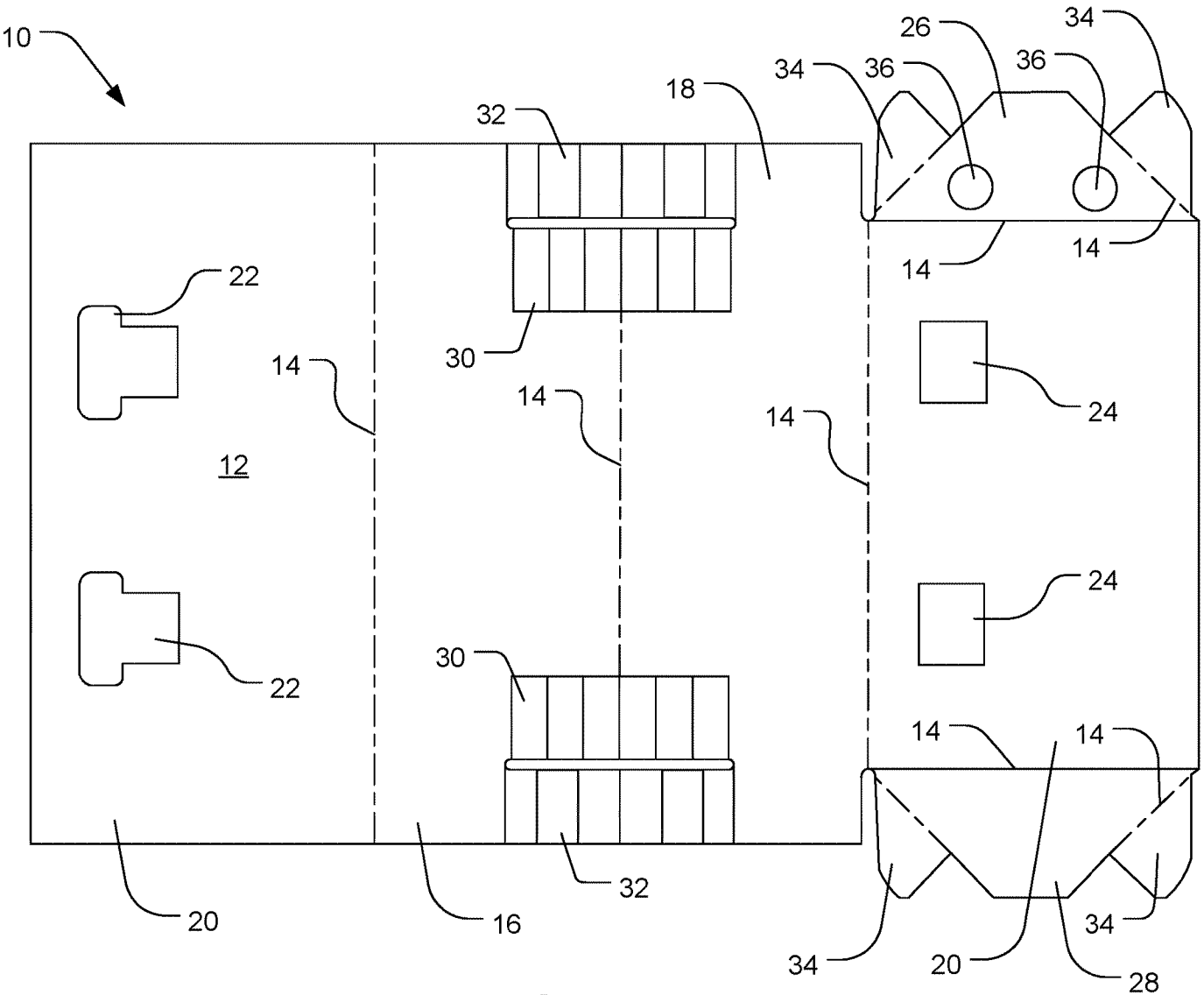
FIG. 6 shows a plan (flat, unfolded) view of an alternate exemplary shipping article.

Another style of shipping article 10 is illustrated in FIG. 6. The embodiment of the shipping article 10 shown in this FIG. 6 illustrates (not necessarily to scale) that differing dimensions of the shipping article 10 may be provided for different articles to be protected during shipping; however, versions of the shipping article 10 having features similar to the embodiments illustrated in the Figures may be provided and sized to receive any size of contents. Similarly, while the embodiment illustrated in FIG. 6 is adapted to receive one article for shipping, further alternate embodiments may be provided for containing and shipping additional articles by altering the dimensions of the shipping article 10 and providing a shelf 40 or shelves 40 similar to those illustrated in FIG. 5.

Figure 7:
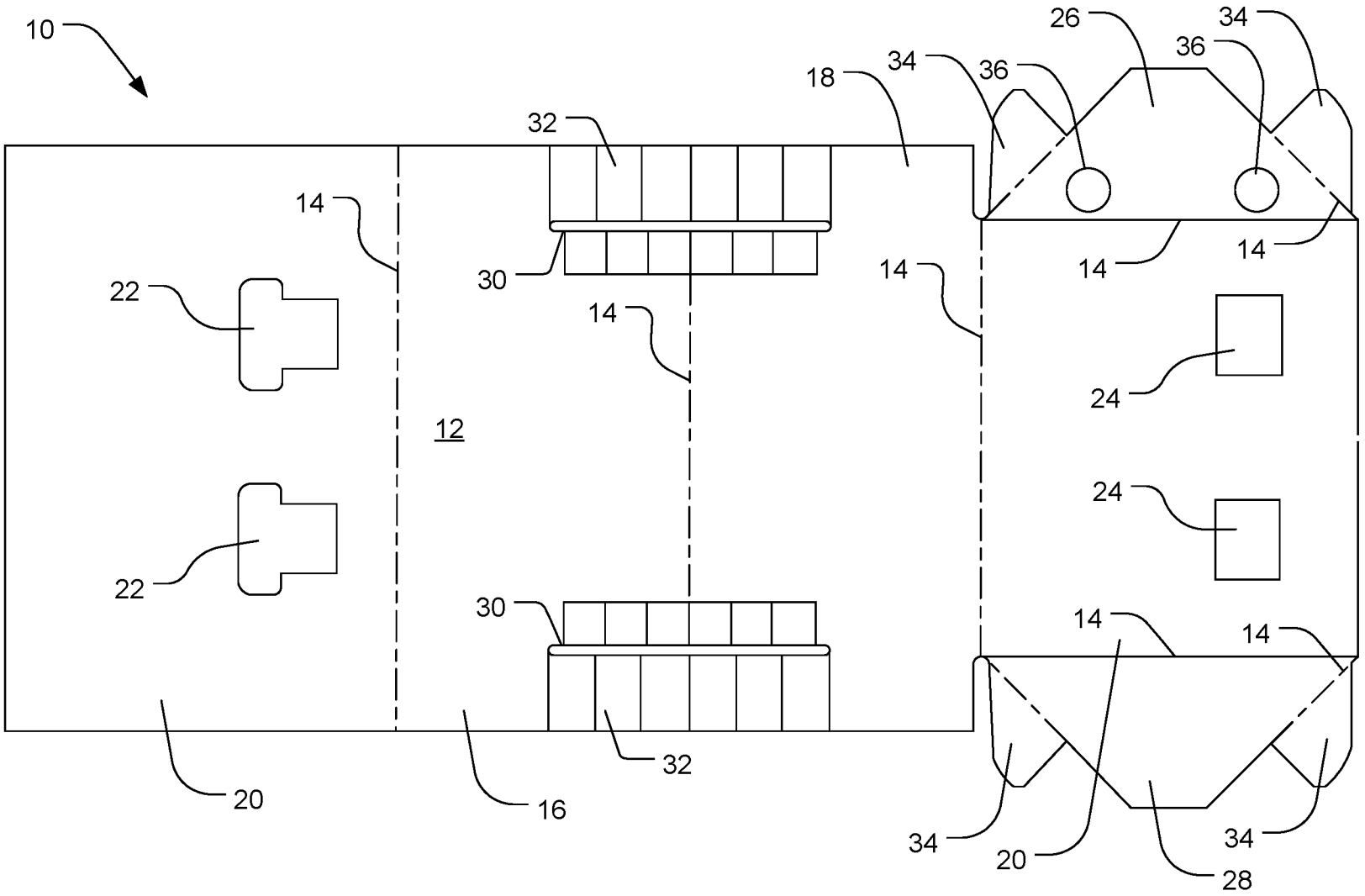
FIG. 7 shows a plan (flat, unfolded) view of an alternate exemplary shipping article.

Another style of shipping article 10 is illustrated in FIG. 7. The embodiment of the shipping article 10 shown in this FIG. 7 is substantially similar to the shipping article 10 illustrated in FIG. 1, but the placement of the locking tabs 22 and the locking slots 24 differs. This embodiment illustrates that the exact placement (or number) of the locking tabs 22 and the locking slots 24 is not critical to the functioning of embodiments of the invention, but illustrates that the placement should correspond between the locking tabs 22 and the locking slots 24 so that they align when the shipping article 10 is folded to its folded state.

While one of ordinary skill in the art will be readily able to select and vary specific sizes of dimensions for the various parts of the various embodiments of the shipping article 10, illustrative dimensions of aspects of specific embodiments of the illustrated embodiments are now provided by way of example only, and not by way of limitation. In particular, turning to FIG. 1, in one embodiment, the shipping article 10 (in its flat state) has a total width of approximately 32⅜ inches (approximately 82.2 cm) and a total height of approximately 17 9/16 inches (approximately 49.7 cm). Each of the sides 16, 18, has a width of approximately 7 inches (approximately 17.8 cm) and a height of approximately 13⅞ inches (approximately 35.2 cm). The additional planar section 20 having the top and bottom extensions 26, 28 has a width of approximately 9 inches (approximately 22.9 cm) and a height (between the score lines 14) of approximately 10 5/16 inches (approximately 26.2 cm). The additional planar section 20 not having the top and bottom extensions 26, 28 (but having the locking tabs 22) has a width of approximately 9⅜ inches (approximately 23.8 cm). The top and bottom extensions 26, 28 have a height of approximately 3⅝ inches (approximately 9.2 cm). The finger holes 36 have a diameter of approximately 1 inch (approximately 2.5 cm).

Turning to FIG. 6, in one embodiment, the shipping article 10 (in its flat state) has a total width of approximately 28⅜ inches (approximately 72.1 cm) and a total height of approximately 19½ inches (approximately 49.5 cm). Each of the sides 16, 18, has a width of approximately 6 inches (approximately 15.2 cm) and a height of approximately 16 13/16 inches (approximately 42.7 cm). The additional planar section 20 having the top and bottom extensions 26, 28 has a width of approximately 8 inches (approximately 20.3 cm) and a height (between the score lines 14) of approximately 13¼ inches (approximately 33.7 cm). The additional planar section 20 not having the top and bottom extensions 26, 28 (but having the locking tabs 22) has a width of approximately 8⅜ inches (approximately 21.3 cm). The top and bottom extensions 26, 28 have a height of approximately 3⅛ inches (approximately 7.9 cm). The finger holes 36 have a diameter of approximately 1 inch (approximately 2.5 cm).

In each of the foregoing specifically-illustrated embodiments, the thickness of the material 12 is approximately ⅛ inch (approximately 0.1 inches or approximately 0.3 cm). As mentioned previously, the material 12 may be 40 ECT corrugated box material. Other thicknesses and weights of materials may be selected and used as desired for varying embodiments of the invention, as may be appreciated by those of ordinary skill in the art.

The present invention may be embodied in other specific forms without departing from its spirit or essential characteristics. The described embodiments are to be considered in all respects only as illustrative and not restrictive. The scope of the invention is, therefore, indicated by the appended claims, rather than by the foregoing description. All changes which come within the meaning and range of equivalency of the claims are to be embraced within their scope.

What is claimed and desired to be secured by Letters Patent is:

1. A shipping article comprising:

a single piece of substantially planar material comprising:

a plurality of substantially planar sections comprising:

a first section having a first width and a first height;

a second section having a second width and a second height:

a third section having a third width and a third height; and a fourth section having a fourth width and a fourth height:

a top extension configured to form a top of a compartment when the single piece of substantially planar material is in a folded configuration; and a bottom extension configured to form a bottom of the compartment when the single piece of substantially planar material is in the folded configuration, wherein:

the first section is separated from the second section by a first fold line and from the third section by a second fold line substantially parallel to the first fold line, the second section is separated from the fourth section by a third fold line substantially parallel to the first fold line, the third section terminates in a first lateral edge, and the fourth section terminates in a second lateral edge;

the first width and the second width are substantially equal;

the third width and the fourth width are substantially equal and greater than the first width and the second width such that when the single piece of substantially planar material is folded along the first fold line, the second fold line, and the third fold line, the single piece of substantially planar material adopts a configuration with a cross section substantially in the form of a right triangle with a hypotenuse formed of the third section and the fourth section in an overlapped relationship;

the third section comprises a locking tab formed from the substantially planar material of the third section and disposed within a perimeter of the third section proximate the first lateral edge; and the fourth section comprises a locking hole disposed proximate the third fold line and configured to receive the locking tab to thereby couple the third section to the fourth section in the overlapped relationship.

2. The shipping article of claim 1, wherein the top extension comprises a hole therein sized to receive a human finger or thumb to facilitate lifting of the shipping article by the top extension during insertion of or removal of the shipping article into or from a secondary shipping container, the hole being disposed below an upper edge of the first section whether the top extension is folded or unfolded along a score line joining the top extension to the at least one of the third section and the fourth section.

3. The shipping article of claim 1, wherein the at least one of the third section and the fourth section comprising the top extension has a main portion with a height that is less than a height of the first section and a height of the second section, and wherein the substantially planar material further comprises a plurality of slits permitting a top portion extending above the top extension to be inwardly displaced after the single piece of substantially planar material is folded and the top extension is folded, thereby holding the top extension in a folded configuration.

4. The shipping article of claim 3, wherein the single piece of substantially planar material comprises a second plurality of slits configured to allow a bottom portion extending below the bottom extension to be inwardly displaced after the single piece of substantially planar material is folded and the bottom extension is folded, thereby holding the bottom extension in another folded configuration.

5. The shipping article of claim 1, wherein the first height, the second height, and the third height are substantially equal, but the fourth height is less than the first height, the second height, and the third height, wherein the top extension comprises two holes spaced apart therein, each sized to receive a human finger or thumb to facilitate lifting of the shipping article by the top extension during insertion of or removal of the shipping article from a secondary shipping container, and wherein the first height extends past the two holes.

6. The shipping article of claim 1, wherein the locking tab comprises a first width and a second width that is greater than the first width, wherein the second width is greater than a width of the locking hole, and wherein the second width is disposed nearer to the first lateral edge than the first width.

7. The shipping article of claim 1, wherein at least one of the first section and the second section comprises an item-separating shelf formed as a portion of the single piece of substantially planar material detached from the at least one of the first section and the second section except along a line substantially perpendicular to the first fold line, whereby the shelf is adapted to fold into the compartment when the single piece of substantially planar material is in the folded configuration to separate the compartment into two vertically spaced sub-compartments each having a height approximately equal to half a height of the compartment.

8. The shipping article of claim 7, wherein the vertically spaced sub-compartments comprise at least one of:

two sub-compartments separated by the item-separating shelf;

three sub-compartments separated by the item-separating shelf and an additional item separating shelf;

and four sub-compartments separated by the item-separating shelf and two other item separating shelves.

9. The shipping article of claim 1, wherein the single piece of substantially planar material comprises corrugated cardboard.

10. The shipping article of claim 1, wherein the compartment is sized to receive an item selected from:

a wine bottle;

an aluminum beverage can;

a beverage bottle;

a beverage growler;

a beverage crowler; and a beverage bomber.

11. The shipping article of claim 1, wherein the shipping article is folded and contained inside an external box with an additional shipping article having a similar configuration to a configuration of the shipping article, the shipping article and the additional shipping article each having a cross section substantially parallel to a top thereof that is substantially in the form of a right triangle, the shipping article and the additional shipping article being disposed together such that a cross section of the shipping article and the additional shipping article together substantially parallel to the top thereof is substantially in the form of a square.

12. A shipping article comprising:

a first piece of substantially planar material;

a second piece of substantially planar material separate from the first piece of substantially planar material; and an external box, wherein:

the first piece of substantially planar material comprises:

a plurality of substantially planar sections comprising:

a first section having a first width and a first height;

a second section having a second width and a second height;

a third section having a third width and a third height; and a fourth section having a fourth width and a fourth height;

a top extension configured to form a top of a compartment when the first piece of substantially planar material is in a folded configuration; and a bottom extension configured to form a bottom of the compartment when the first piece of substantially planar material is in the folded configuration;

the first section is separated from the second section by a first fold line and from the third section by a second fold line substantially parallel to the first fold line, the second section is separated from the fourth section by a third fold line substantially parallel to the first fold line, the third section terminates in a first lateral edge, and the fourth section terminates in a second lateral edge;

the first width and the second width are substantially equal;

the third width and the fourth width are substantially equal and greater than the first width and the second width such that when the first piece of substantially planar material is folded along the first fold line, the second fold line, and the third fold line, the first piece of substantially planar material adopts a folded configuration with a cross section substantially in the form of a right triangle with a first hypotenuse formed of the third section and the fourth section in an overlapped relationship;

the third section comprises a locking tab formed from the substantially planar material of the third section and disposed within a perimeter of the third section proximate the first lateral edge;

the fourth section comprises a locking hole disposed proximate the third fold line and configured to receive the locking tab to thereby couple the third section to the fourth section in the overlapped relationship;

the second piece of substantially planar material is configured to be folded to adopt a second folded configuration with a cross section substantially in the form of a right triangle having a second hypotenuse; and the first piece of substantially planar material is configured to be placed together with the second piece of substantially planar material into the external box with the first hypotenuse disposed adjacent to the second hypotenuse.

13. The shipping article of claim 12, wherein a length of the first hypotenuse is substantially equal to a length of the second hypotenuse.

14. The shipping article of claim 12, wherein the second hypotenuse is formed of two sections of the second piece of substantially planar material in an overlapped relationship such that a first article to be shipped disposed within the compartment of the first piece of substantially planar material is separated from a second article to be shipped disposed within another compartment of the second piece of substantially planar material by at least the two sections of the second piece of substantially planar material, as well as the third section and the fourth section of the first piece of substantially planar material.

15. The shipping article of claim 12, wherein the second piece of substantially planar material has a configuration that is the same as a configuration of the first piece of substantially planar material.

* * * * *